US010634328B2

(12) United States Patent
Liu et al.

(10) Patent No.: US 10,634,328 B2
(45) Date of Patent: Apr. 28, 2020

(54) LED LIGHTING SYSTEM

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Xiaoyun Liu, Zhejiang (CN); Jianguo Dong, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/355,370

(22) Filed: Mar. 15, 2019

(65) Prior Publication Data

US 2019/0285258 A1 Sep. 19, 2019

(30) Foreign Application Priority Data

Mar. 16, 2018 (CN) ..... 2018 1 0222615

(51) Int. Cl.

| | |
|---|---|
| ***F21V 21/35*** | (2006.01) |
| ***F21V 23/00*** | (2015.01) |
| ***F21V 23/06*** | (2006.01) |
| ***F21S 2/00*** | (2016.01) |
| ***F21Y 115/10*** | (2016.01) |

(52) U.S. Cl.

CPC ..... *F21V 21/35* (2013.01); *F21S 2/00* (2013.01); *F21V 23/002* (2013.01); *F21V 23/06* (2013.01); *F21Y 2115/10* (2016.08)

(58) Field of Classification Search

CPC ..... F21V 21/35; F21V 23/002; F21V 23/06

See application file for complete search history.

(56) References Cited

U.S. PATENT DOCUMENTS

| | | | | |
|---|---|---|---|---|
| 4,747,025 | A * | 5/1988 | Barton | A47F 5/0846 211/94.01 |
| 5,455,754 | A * | 10/1995 | Hoffner | F21V 21/35 362/147 |
| 6,022,129 | A * | 2/2000 | Tang | F21V 21/12 362/147 |
| 7,455,535 | B2 * | 11/2008 | Insalaco | H01R 25/14 439/110 |
| 7,793,907 | B2 * | 9/2010 | Woodward | F16G 13/16 248/317 |
| 8,186,847 | B2 * | 5/2012 | Hu | F21V 15/01 362/225 |
| 2004/0005798 | A1 * | 1/2004 | Lin | H01R 25/14 439/110 |
| 2007/0133207 | A1 * | 6/2007 | Pryor | F21V 21/35 362/253 |

(Continued)

*Primary Examiner* — Alexander K Garlen

(74) *Attorney, Agent, or Firm* — Wang Law Firm, Inc.

(57) ABSTRACT

The invention relates to an LED lighting system, which comprises a power supply rail and a power supply input head connected to the power supply rail; The power input head comprises a fixing frame, a conducting contact positioned on the fixing frame and external wire connected with the conducting contact; The first conductive plate is arranged on the power supply rail, and the conductive contact of the power supply input head is in contact with the first conductive plate to realize the conduction of the power supply rail. Compared with the prior art, the LED lighting system provided by the invention has simple structure, diverse combination modes and better applicability.

8 Claims, 6 Drawing Sheets

(56) References Cited

U.S. PATENT DOCUMENTS

| | | | | |
|---|---|---|---|---|
| 2011/0051433 | A1* | 3/2011 | Kao | F21V 21/088 362/396 |
| 2016/0369981 | A1* | 12/2016 | Emde | F21S 6/003 |
| 2019/0064426 | A1* | 2/2019 | Ju | F21S 2/00 |
| 2019/0211983 | A1* | 7/2019 | Shine | F21S 2/005 |

* cited by examiner

LED LIGHTING SYSTEM

RELATED APPLICATION

This application claims priority to Chinese Patent Application No. CN 201810222615.7, filed on Mar. 16, 2018.

FIELD OF THE TECHNOLOGY

The present invention relates to lighting equipment field, with particular emphasis on a LED lighting system.

BACKGROUND OF THE INVENTION

LEDs are widely used in daily life due to their high luminous efficiency and power saving. At present, LED spotlights are often used in the monopoly counters, shopping malls and the exhibition hall and other occasions to provide lighting and product luminous effect. In order to simplify the structure of the lamp body, researchers began use rail technology to supply power to improve the linearity and aesthetics of the lamp body installation.

The invention patent CN203605069U discloses "a track light strip", which comprises lamp shell and aluminum substrate located in the lamp shell, power module, and LED lamp bead located on the aluminum substrate and electrically connected to the power module, the power module is connected to the external power source to realize power supply of the lamp beads.

Although the device can effectively realize the conduction of the lamp body, each LED lamp bead needs to be connected to the external power line, so that there are too many external wires, the site is scattered, and the installation and maintenance are complicated. At the same time, if there are multiple guides with a certain angle in the LED system. In order to ensure the integrity of the system, most of the prior art uses corner joints, but the existing corners cannot guarantee the continuity of electrical conduction between multiple connected guide rails; and the existing lamp body and the rail are also mainly connected by wires to conduct electricity, which not only causes the system is complicated, and it is inconvenient to install because there are too many wires, and there are many safety hazards.

BRIEF SUMMARY OF THE INVENTION

Therefore, the present invention provides LED lighting system with a simple structure and simplified power supply mode. The system is integrated and connected, which can effectively avoid the problem of too many wires and improve the overall aesthetics.

the technical solution adopted by the present invention to solve the above problems is as follows: A LED lighting system, including power supply rail and power input head connected to the power supply rail;

characterized in that:

the power input head including fixing frame, conductive contact positioned on the fixing frame, and external wire connected to the conductive contact;

the power supply rail providing with first conductive plate, and the conductive contact of the power input head being in contact with the first conductive plates to achieve electrical conduction of the power supply rail.

advantageously, the fixing frame is provided with limiting rib alternately which is shaped along the access direction of the external wire to fix the conductive contact;

the upper end of the conductive contact is a spring-like structure that is snapped between adjacent limiting ribs, and the lower end of the conductive contact is a cylindrical structure;

the rear end of the fixing frame is an opening design, and the opening is provided with a intermediate rail connecting with the two side walls of the fixing frame;

the external wire passes through the intermediate rail from bottom to top and connects with the lower end of the conductive contact.

the lighting system is complex and diverse. In order to ensure the continuity of conduction between the power supply guide rails set at a certain angle and connected, reduce the power input device and simplify the system structure, the system further includes an adapter disposed between at least two power supply rails disposed at a certain angle and connected;

the adapter has connection arms adapted to the grooved structure of at least two power supply rails;

second conductive plate corresponding to the position of the first conductive plate is installed in each connecting arm;

the second conductive plate is provided with a first conductive contact which is extended and connected with the first conductive plate to obtain electricity;

the second conductive plate of the first connecting arm is electrically connected to the second conductive plates of the second connecting arm, making that when a power supply rail is powered on, other power supply rails are powered on.

Advantageously, the first connecting arm is a hollow columnar structure having an annular groove at one end;

the second connecting arm has a hollow square cylinder, and the upper end of one end of the hollow square cylinder is provided with an arcuate notch which is adapted to the annular groove and allows the first connecting arm to rotate on it through the annular groove;

one end of the second conductive plate of the first connecting arm and one end of the second conductive plate of the second connecting arm are connected through wire;

the second connecting arm further includes a positioning end cover for preventing the first connecting arm from falling off the arcuate notch;

the positioning end cover is inserted into the hollow square cylinder from one end of the hollow square cylinder close to the arcuate notch and is fixedly connected with the hollow square cylinder.

Advantageously, the first connecting arm and the second connecting arms are integrally formed, and one end of the second conductive plate of the first connecting arm and one end of the second conductive plate of the second connecting arm is integrally connected or connected by wire; the integrally formed adapter is clamped between the upper and lower casings to fix the second conductive plate.

In order to make the overall structure of the system more beautiful, the LED lamp body assembly in the LED lighting system includes frame body and LED lamp connected to the frame body;

two inner side walls of the power supply rail are respectively provided with first groove which is externally concave, and a first rib with an outward bulge is formed at the corresponding positions of the two outer side walls of the frame body, and the first rib is buckled into the first groove to realize a fixed connection between LED lamp body component and power supply rail; or the inner side of the top surface of the power supply rail is made of a magnetic steel material, and the outer side of the top surface of the frame body formed of a magnetic material, and the frame body is inserted into the groove structure opening of the power supply rail during assembly, and the top surface of the power supply rail absorbs the top surface of the frame body moving toward the top surface of the power supply rail so as to fix the LED lamp body component.

Advantageously the LED lamp body assembly further includes third conductive plate located in the frame body, second conductive contact located on the third conductive plate and extending out of the frame body;

the LED lamp is fixed to the third conductive plate;

the second conductive contact contacts the first conductive plate when the frame body and the grooved structure of power supply rail are assembled and fixed, so that the third conductive plate is energized and then LED lamp is illuminated.

Advantageously, the LED lamp body assembly further includes third conductive plate located in the frame body and connected to the frame body, and second conductive contact located on the third conductive plate and extending from the frame body;

the bottom surface of the frame body is a conductive material, and the LED lamp is a spotlight and is rotatably connected to the bottom surface of the frame body;

the second conductive contact contacts the first conductive plate when the frame body and the grooved structure of the power supply rail are assembled and fixed, making the third conductive plate receive electricity and then make the LED lamp on the bottom surface of frame body realize lighting.

Advantageously, the LED lamp is connected to the bottom surface of the frame through a connecting rod;

the LED lamp can make axial horizontal rotation on the bottom surface of the frame body centering on the connecting rod shaft to achieve horizontal angle adjustment;

the other end of the connecting rod is a crossbar designed at an angle to the connecting rod shaft, and the crossbar is located inside the LED lamp;

a u-shaped groove is arranged on the LED lamp so that the LED lamp can rotate up and down with the crossbar as the axis to achieve vertical angle adjustment.

Advantageously, the power input head further includes a fixing seat and a cover sheet that are located above the front of the fixing frame to cover the fixing frame;

the fixing seat is provided with a guiding strip for guiding the fixing frame to insert into the fixing seat and fix the fixing frame, and the end surface is provided with a strip groove for inserting the power supply rail into the fixing frame;

the fixing seat is fixedly mounted to the mounting surface by screw method.

Compared with the prior art, the invention has the advantages that the conductive contact is connected with the external wire and fixed on the fixing frame, thus integrating the previous power input device. The conductive contact is connected with the conductive plate on the power supply rail to supply power to the rail, which avoids the confusion caused by excessive power lines in the past; At the same time, the electrical connection between the guide rail and the guide rail can be realized through the adapter, and the electrical conduction of one guide rail can drive the electrical conduction of other guide rails connected with it, which effectively realizes the purpose of reducing the power input device and simplifying the system structure; The lamp body component is wirelessly connected to the power supply rail through conductive contacts, which further simplifies the system structure, and the use of fixed seat can facilitate the user according to different requirements for the installation of different installation methods and surface installation, help to promote the personalized design of the system; The upper and lower rotation of the spotlights makes it convenient for users to adjust the irradiation at different angles, and the applicability is better.

BRIEF DESCRIPTION OF THE DRAWINGS

The drawings described herein are intended to promote a further understanding of the present invention, as follows.

DETAILED DESCRIPTION OF THE INVENTION

The present application is illustrated by way of the following detailed description based on of the accompanying drawings. It should be noted that illustration to the embodiment in this application is not intended to limit the invention.

In addition, the terms "first", "second", "third" and the like in the present application are used for descriptive purposes only, and are not to be understood as indicating or implied the relative importance or the number of well-known technical features.

Figure 1:
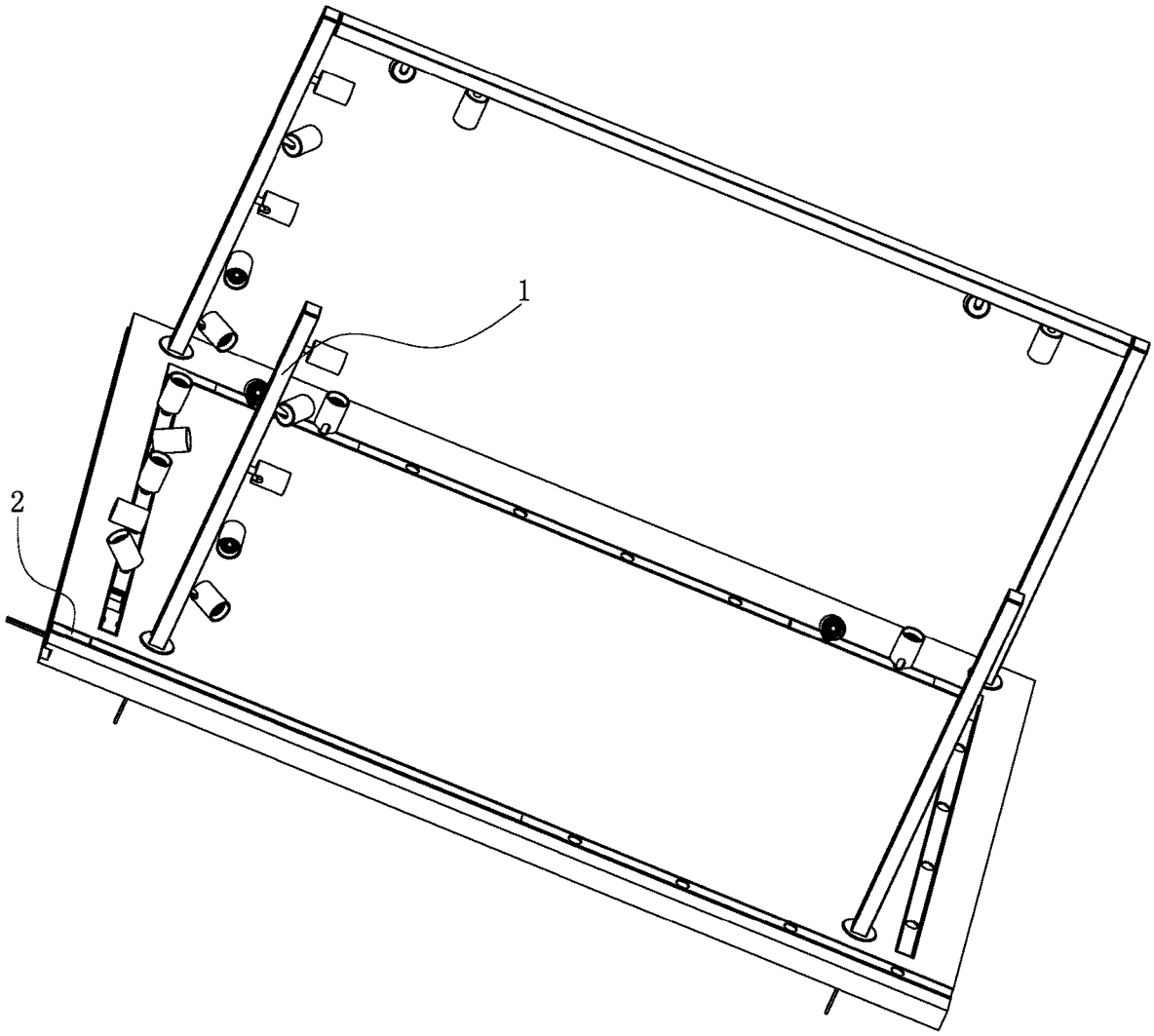
FIG. 1 is a schematic structural view of LED lighting system of the present invention.

FIG. 1 shows a structural diagram of the LED lighting system applied in this application, but it should be noted that this does not mean that there is only one structure in this application, and other structures that do not deviate from the main idea of the invention of this application are within the protection scope of this application.

Figure 2A:
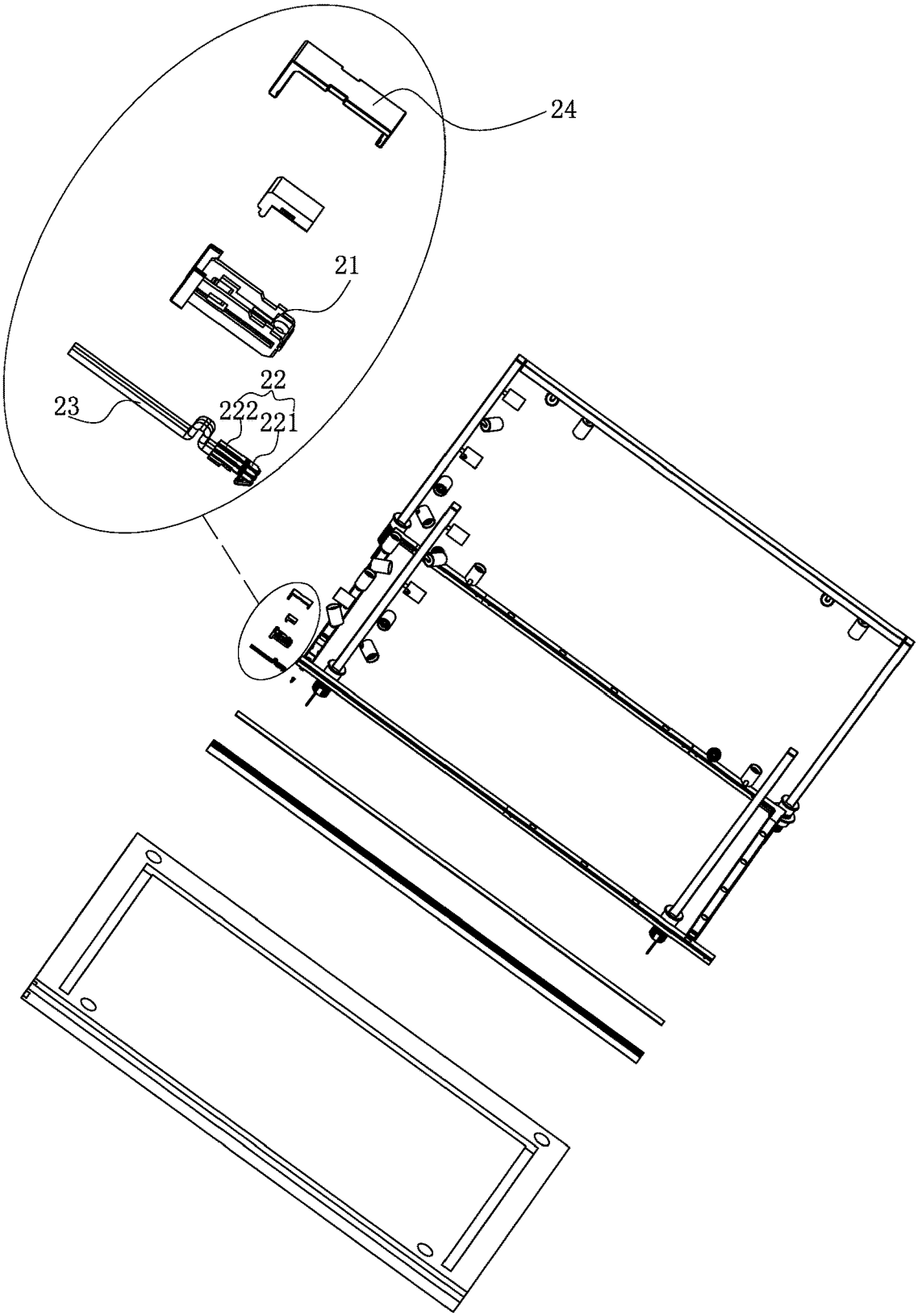
FIG. 2 (*a*) and FIG. 2 (*b*) are partial exploded views at different angles of the power input head of FIG. 1.
Figure 2B:
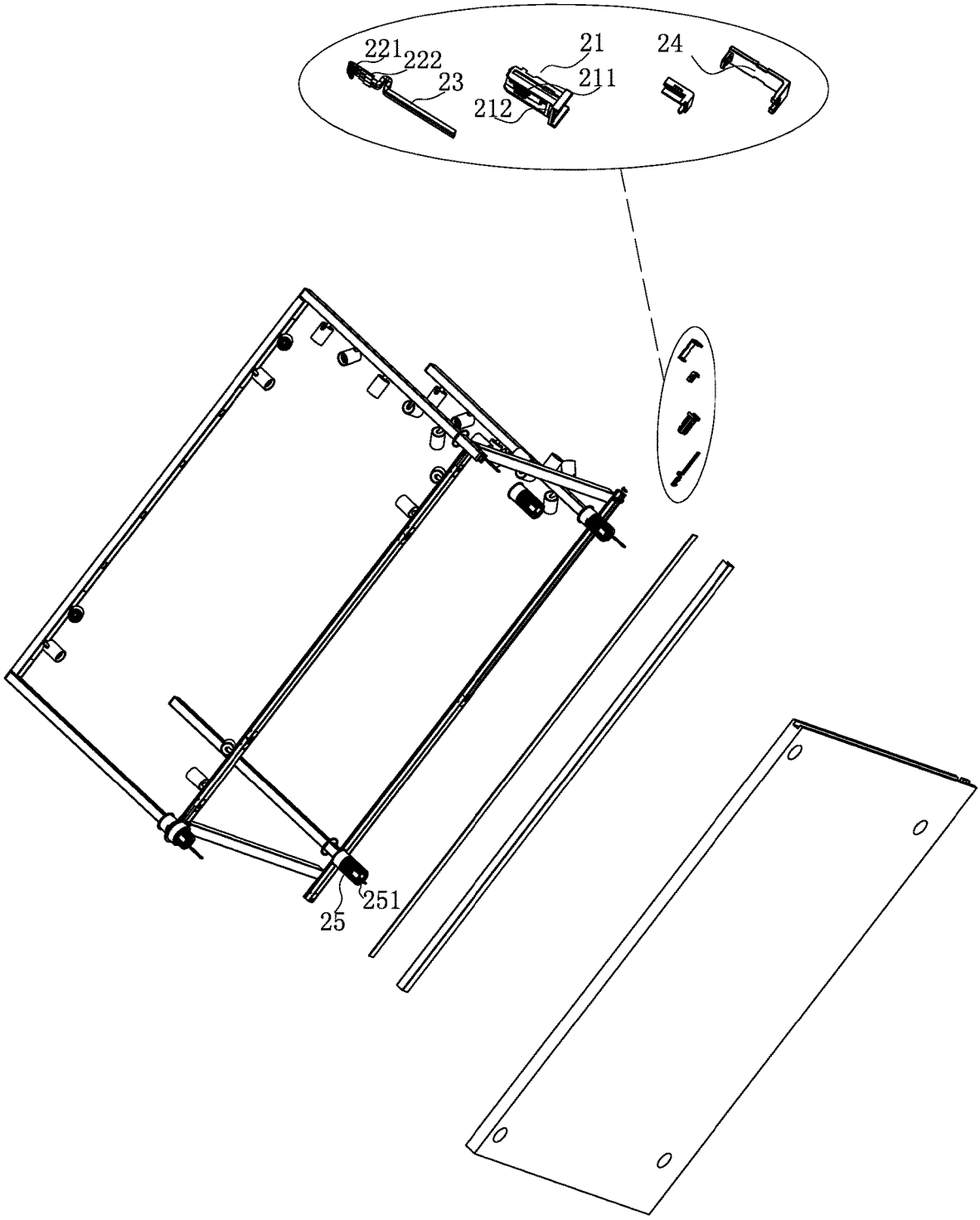

FIG. 1 combined with FIG. 2 (*a*), 2 (*b*), the lighting system includes a power supply rail 1 with a grooved structure and a power input head 2 at one end of the power supply rail 1; the power input head 2 includes a fixing frame 21 mounted in the power supply rail 1 and a conductive contact 22 on the reverse side of the fixing frame 21 and external wire 23 connected to the conductive contact 22; The power supply rail 1 is provided with a first conductive plate 11, and the conductive contact 22 of the power input head 2 is in contact with the first conductive plate 11 to supply power to the power supply rail 1.

Referring to FIG. 2(*a*) and 2(*b*), the reverse of the fixing frame 21 is provided with limiting rib 211 alternately which is shaped along the access direction of the external wire 23 to fix the conductive contact 22, the rear end of the fixing frame 21 is an opening design, the opening is provided with a intermediate rail 212 connecting the two side walls of the fixing frame 21; correspondingly, the upper end 221 of the conductive contact 22 is a spring-like structure that is caught between adjacent limiting ribs 211,The lower end 222 of the conductive contact 22 is a cylindrical structure; the external wire 23 passes through the intermediate rail 212 from bottom to top and connects with the lower end of the conductive contact 22, a cylindrical structure. In this way, the integration of the power input device can be effectively realized, thereby making the power input device is more compact and can be better applied to the rail type LED lamp.

Figure 3A:
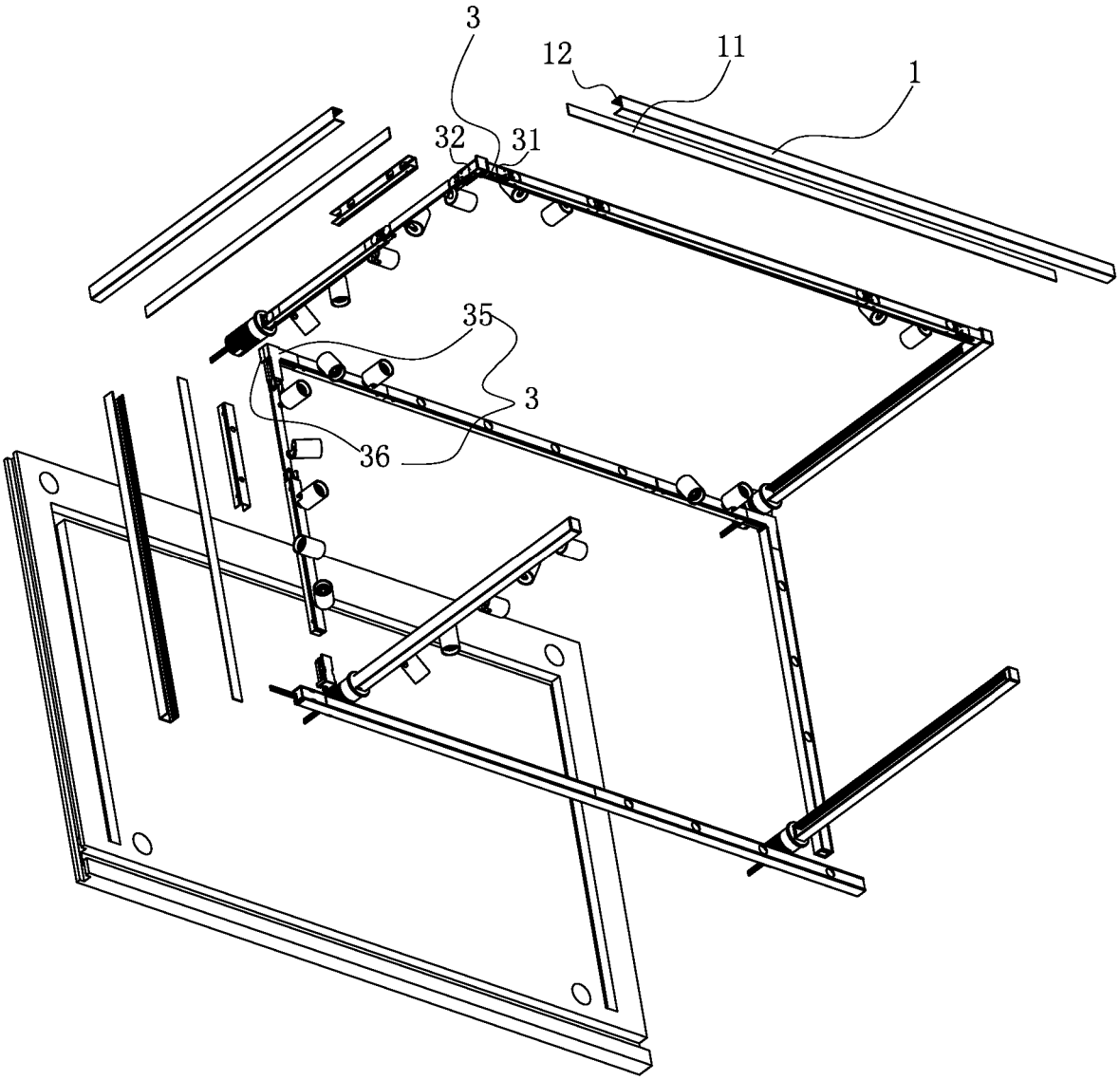
FIGS. 3(*a*) and 3(*b*) are partial exploded views at different angles of the adapter of FIG. 1.
Figure 3B:
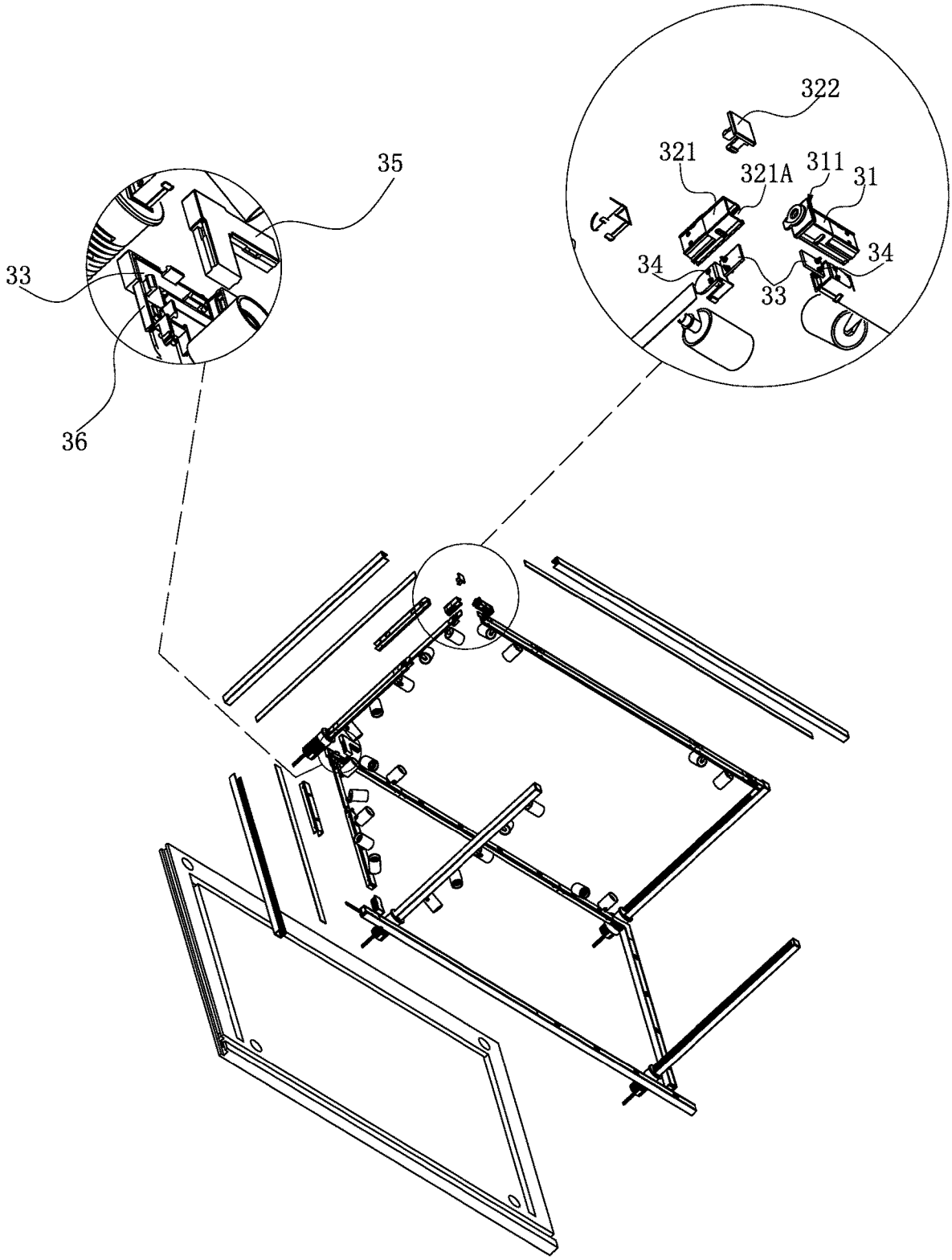

The lighting system is complex and diverse, in order to ensure the continuity of conduction between the power supply rails which are arranged at a certain angle, while reducing the power input device, simplifying the system structure, as shown in FIG. 3(*a*), 3(*b*), the system also comprises a adapter 3 arranged between at least two power supply rails disposed at a certain angle and connected, the adapter 3 has connection arms 31,32 adapted to the grooved structure of at least two power supply rails 1, and a second conductive plate 33 corresponding to the position of the first conductive plate 11 is installed in each connecting arm, at the same time, the second conductive plate 33 is provided with a first conductive contact 34 which is extended and connected with the first conductive plate 11 to obtain electricity; wherein the second conductive plate 33 of the first connecting arm 31 and the second conductive plates 33 of the second connecting arm 32 are electrically connected. so that when a rail is powered on, the second conductive plate corresponding to one of the connecting arms is also conducted due to the action of the first conductive contact 34 of the connecting arm, and then the second conductive plate is electrically connected with the conductive plate of the other connecting arm and the electrical conductivity of the power supply rail corresponding to the connecting arm.

Referring again to FIGS. 3(*a*) and 3(*b*), the first connecting arm 31 is a hollow columnar structure having an annular groove 311 at one end. The second connecting arm 32 has a hollow square cylinder 321, and the upper end of one end of the hollow square cylinder 321 is provided with an arcuate notch 321A which is adapted to the annular groove 311 and allows the first connecting arm 31 to rotate on it through the annular groove 311; One end of the second conductive plate 33 of the first connecting arm 31 and one end of the second conductive plate 33 of the second connecting arm 32 are connected through wire (not shown in the figures); The second connecting arm 32 further includes a positioning end cover 322 for preventing the first connecting arm 31 from falling off the arcuate notch 321A. The positioning end cover 322 is inserted into the hollow square cylinder 321 from one end of the hollow square cylinder 321 close to the arcuate notch 321A and is fixedly connected with the hollow square cylinder 321. With this design, one of the power supply rails connected with the adapter assembly can realize axial rotation with its own axis, so as to adjust the irradiation angle of LED lamp body components to meet different irradiation requirements.

Of course, the adapter may also be a non-rotatable structure, as shown in FIG. 3(*b*), the first connecting arm 31 and the second connecting arms 32 are integrally formed, one end of the second conductive plate 33 of the first connecting arm 31 and one end of the second conductive plate 33 of the second connecting arm 32 is integrally connected or connected by wire (not shown in the figures) such that the integrally formed adapter 3 is clamped between the upper and lower casings 35 ,36 to fix the second conductive plate 33.

In order to make it easier to assemble the light body assembly and guide rail, the overall structure of the system is more beautiful, the LED lamp body assembly 4 in the the LED lighting system includes a frame body 41, and an LED lamp 42 connected to the frame body 41, the two inner side walls of the power supply rail 1 are respectively provided with first groove 12 which is externally concave, a first rib 411 with an outward bulge is formed at the corresponding positions of the two outer side walls of the frame body 41. the first rib 411 is buckled into the first groove 12 to realize a fixed connection between LED lamp body component 4 and power supply rail 1.

Of course, the inner side of the top surface of the power supply rail 1 may be made of a magnetic steel material, and the outer side of the top surface of the frame body 41 may be formed of a magnetic material, and the frame body 41 is inserted into the groove structure opening of the power supply rail 1 during assembly. The top surface of the power supply rail 1 absorbs the top surface of the frame body 41 moving toward the top surface of the power supply rail 1 so as to fix the LED lamp body component 4.

Figure 4:
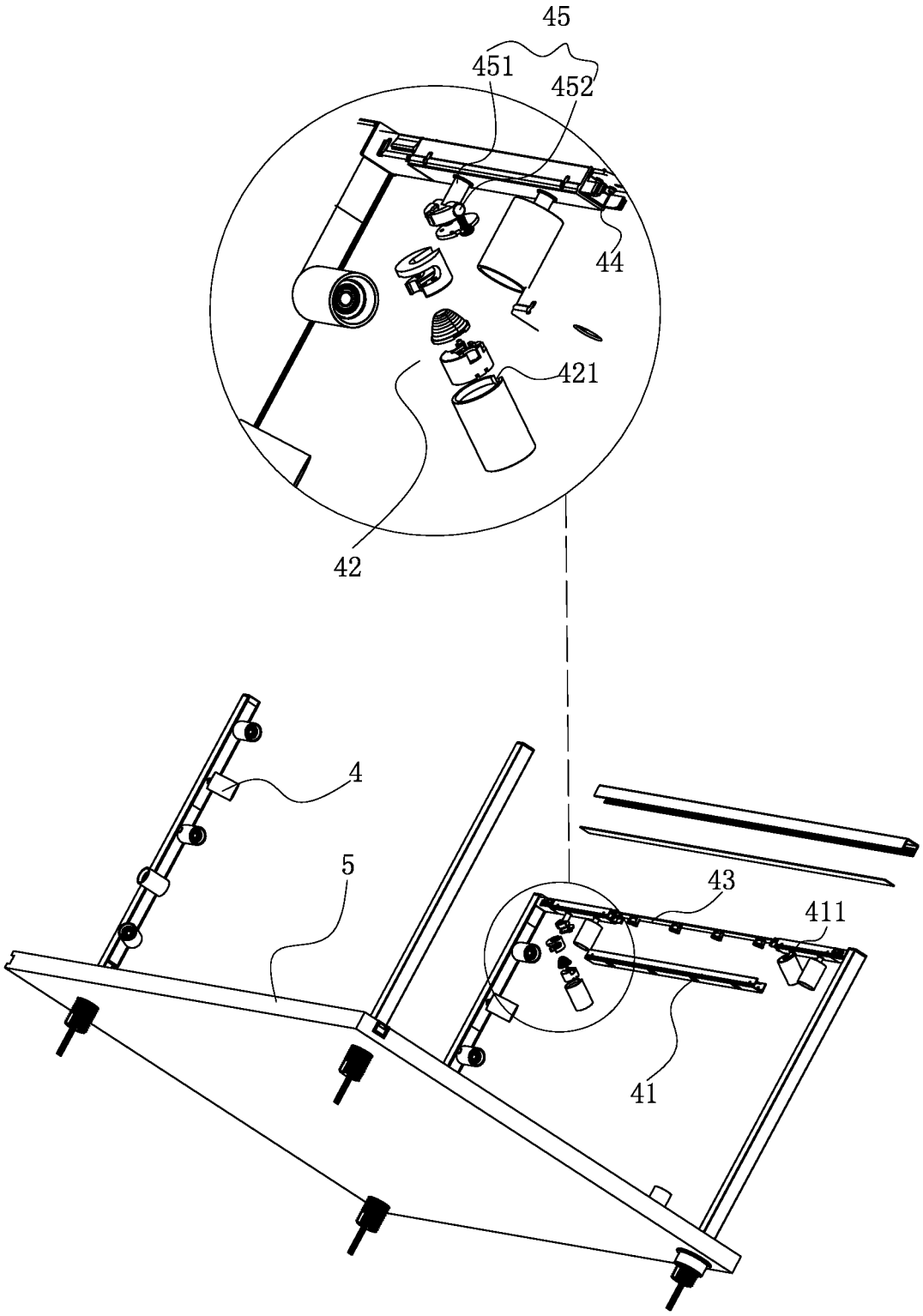
FIG. 4 is a layout exploded view of the LED lamp of FIG. 1.

Referring to FIG. 4, the LED lamp body assembly 4 further includes a third conductive plate 43 located in the frame body 41, a second conductive contact 44 located on the third conductive plate 43 and extending out of the frame body 41; the LED lamp 42 is fixed to the third conductive plate 43. The second conductive contact 44 contacts the first conductive plate 11 when the frame body 41 and the grooved structure of power supply rail 1 are assembled and fixed, so that the third conductive plate 43 is energized and then LED lamp 42 is illuminated.

The LED lamp body assembly may also be configured as follows: the LED lamp body assembly 4 further includes a third conductive plate 43 located in the frame body 41 and connected to the frame body 41, and a second conductive contact 44 located on the third conductive plate 43 and extending from the frame body 41; the bottom surface of the frame body 41 is a conductive material, the LED lamp 42 is a spotlight and is rotatably connected to the bottom surface of the frame body 41; The second conductive contact 44 contacts the first conductive plate 11 when the frame body 41 and the grooved structure of the power supply rail 1 are assembled and fixed, making the third conductive plate 43 receive electricity and then make the LED lamp 42 on the bottom surface of frame body 41 realize lighting.

As shown in FIG. 4, the LED lamp 42 is connected to the bottom surface of the frame 41 through a connecting rod 45, and the other end of the connecting rod 45 is a crossbar 452 designed at an angle to the connecting rod shaft 451. The crossbar 452 is located inside the LED lamp 42. The LED lamp 42 can make axial horizontal rotation on the bottom surface of the frame body 41 centering on the connecting rod shaft 451 to achieve horizontal angle adjustment; A u-shaped groove 421 is arranged on the LED lamp 42 so that the LED lamp 42 can rotate up and down with the crossbar 452 as the axis to achieve vertical Angle adjustment.

As shown in FIGS. 2 (*a*) and 2 (*b*), the power input head 2 also includes a fixing seat 25 and a cover sheet 24 that are located above the front of the fixing frame 21 to cover the fixing frame 21, The fixing seat 25 is provided with a guiding strip 251 for guiding the fixing frame 21 to insert into the fixing seat 25 and fix the fixing frame 21, and the end surface is provided with a strip groove 252 for inserting the power supply rail 1 into the fixing frame 21, the fixing seat 25 is fixedly mounted to the mounting surface 5 by screw method. This can facilitate users according to different needs and different ways of installation, so as to complete the personality collocation.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A LED lighting system comprising;

a power input head having a fixing frame, a conductive contact positioned on the fixing frame, and an external wire connected to the conductive contact;

a power supply rail having a first conductive plate connected to the conductive contact of the power input head; and an adapter disposed between at least two power supply rails disposed at a certain angle and connected, the adapter has connection arms adapted to the grooved structure of at least two adjacent power supply rails, a second conductive plate corresponding to the position of the first conductive plate is installed in each connecting arm, the second conductive plate is provided with a first conductive contact which is extended and connected with the first conductive plate to obtain electricity, the second conductive plate of the first connecting arm is electrically connected to the second conductive plates of the second connecting arm, such that when one power supply rail is powered on, other adjacent power supply rail is also powered on, wherein the first connecting arm is a hollow columnar structure having an annular groove at one end, the second connecting arm has a hollow square cylinder, and the upper end of one end of the hollow square cylinder is provided with an arcuate notch which is adapted to the annular groove and allows the first connecting arm to rotate on it through the annular groove, one end of the second conductive plate of the first connecting arm and one end of the second conductive plate of the second connecting arm are connected through wire, the second connecting arm further includes a positioning end cover for preventing the first connecting arm from falling off the arcuate notch, and the positioning end cover is inserted into the hollow square cylinder from one end of the hollow square cylinder close to the arcuate notch and is fixedly connected with the hollow square cylinder.

2. The LED lighting system as claimed in claim 1, wherein the fixing frame includes a limiting rib to connect to the conductive contact;

an upper end of the conductive contact is a spring-like structure and snaps between adjacent limiting ribs, and a lower end of the conductive contact is a cylindrical structure;

a rear end of the fixing frame has an opening, and the opening is provided with an intermediate rail connected to two side walls of the fixing frame;

the external wire passes through the intermediate rail from bottom to top and connects with the lower end of the conductive contact.

3. The LED lighting system as claimed in claim 1, wherein the first connecting arm and the second connecting arms are integrally formed, and one end of the second conductive plate of the first connecting arm and one end of the second conductive plate of the second connecting arm is connected or connected by wire; the integrally formed adapter is clamped between the upper and lower casings to fix the second conductive plate.

4. The LED lighting system as claimed in claim 1, wherein the LED lamp body assembly in the LED lighting system includes frame body and LED lamp connected to the frame body;

two inner side walls of the power supply rail are respectively provided with a first groove which is externally concave, and a first rib with an outward bulge is formed at the corresponding positions of the two outer side walls of the frame body, and the first rib is buckled into the first groove to realize a fixed connection between the LED lamp body component and the power supply rail; or the inner side of the top surface of the power supply rail is made of a magnetic steel material, and the outer side of the top surface of the frame body formed of a magnetic material, and the frame body is inserted into the groove structure opening of the power supply rail during assembly, and the top surface of the power supply rail absorbs the top surface of the frame body moving toward the top surface of the power supply rail so as to fix the LED lamp body component.

5. The LED lighting system as claimed in claim 4, wherein the LED lamp body assembly further includes a third conductive plate located in the frame body, a second conductive contact located on the third conductive plate and extending out of the frame body;

the LED lamp is fixed to the third conductive plate;

the second conductive contact contacts the first conductive plate when the frame body and the grooved structure of the power supply rail are assembled and fixed, so that the third conductive plate is energized and then the LED lamp is illuminated.

6. The LED lighting system as claimed in claim 4, wherein the LED lamp body assembly further includes a third conductive plate located in the frame body and connected to the frame body, and a second conductive contact located on the third conductive plate and extending from the frame body;

the bottom surface of the frame body is a conductive material, and the LED lamp is a spotlight and is rotatably connected to the bottom surface of the frame body;

the second conductive contact contacts the first conductive plate when the frame body and the grooved structure of the power supply rail are assembled and fixed, such that the third conductive plate receives electricity and then turns on the LED lamp on the bottom surface of frame body.

7. The LED lighting system as claimed in claim 6, wherein the LED lamp is connected to the bottom surface of the frame through a connecting rod;

the LED lamp can make axial horizontal rotation on the bottom surface of the frame body centering on the connecting rod shaft to achieve horizontal angle adjustment;

the other end of the connecting rod is a crossbar designed at an angle to the connecting rod shaft and the crossbar is located inside the LED lamp;

a u-shaped groove is arranged on the LED lamp so that the LED lamp can rotate up and down with the crossbar as the axis to achieve vertical angle adjustment.

8. The LED lighting system as claimed in claim 2, wherein the power input head further includes a fixing seat and a cover sheet that are located above the front of the fixing frame to cover the fixing frame;

the fixing seat is provided with a guiding strip for guiding the fixing frame to insert into the fixing seat and fix the fixing frame;

the fixing seat is fixedly mounted to the mounting surface through screws.

* * * * *